US007808455B2

(12) United States Patent
Ono

(10) Patent No.: US 7,808,455 B2
(45) Date of Patent: Oct. 5, 2010

(54) DISPLAY APPARATUS

(75) Inventor: Shinya Ono, Yokohama (JP)

(73) Assignee: Global OLED Technology LLC, Wilmington, DE (US)

( * ) Notice: Subject to any disclaimer, the term of this patent is extended or adjusted under 35 U.S.C. 154(b) by 807 days.

(21) Appl. No.: 11/366,283

(22) Filed: Mar. 2, 2006

(65) Prior Publication Data

US 2006/0208975 A1 Sep. 21, 2006

(30) Foreign Application Priority Data

Mar. 17, 2005 (JP) ..... 2005-077967

(51) Int. Cl.
*G09G 3/30* (2006.01)

(52) U.S. Cl. ..... 345/76; 345/78

(58) Field of Classification Search ..... 345/76, 345/126, 82–83, 78; 315/169.3
See application file for complete search history.

(56) References Cited

U.S. PATENT DOCUMENTS

| | | | | |
|---|---|---|---|---|
| 6,680,580 | B1 * | 1/2004 | Sung | 315/169.3 |
| 2003/0030603 | A1 * | 2/2003 | Shimoda | 345/76 |
| 2004/0007989 | A1 * | 1/2004 | Li | 315/169.3 |
| 2004/0041525 | A1 * | 3/2004 | Park et al. | 315/169.3 |
| 2004/0056605 | A1 * | 3/2004 | Yoshida | 315/169.3 |
| 2004/0174349 | A1 * | 9/2004 | Libsch et al. | 345/204 |
| 2004/0252089 | A1 * | 12/2004 | Ono et al. | 345/82 |
| 2005/0052377 | A1 * | 3/2005 | Hsueh | 345/82 |
| 2005/0057459 | A1 * | 3/2005 | Miyazawa | 345/76 |
| 2005/0099371 | A1 * | 5/2005 | Koyama | 345/76 |
| 2005/0104818 | A1 * | 5/2005 | Kwak et al. | 345/76 |
| 2005/0179399 | A1 * | 8/2005 | Leo et al. | 315/169.3 |
| 2005/0218946 | A1 * | 10/2005 | Miyazawa | 327/112 |
| 2006/0012310 | A1 * | 1/2006 | Chen et al. | 315/169.3 |
| 2006/0176250 | A1 * | 8/2006 | Nathan et al. | 345/76 |

* cited by examiner

*Primary Examiner*—Chanh Nguyen
*Assistant Examiner*—Robert M Stone
(74) *Attorney, Agent, or Firm*—Morgan Lewis & Bockius LLP

(57) ABSTRACT

Apparatus for compensating for a threshold voltage of a driver element having gate and drain electrodes which controls current flowing in a light emitting element effective in an on and off state. A capacitor is disposed between the gate electrode and a drain electrode when the light emitting element is in the on state emits light and when the light emitting element is in the off state, applying a voltage to the gate and the source of the driver element and a threshold voltage between the gate and drain electrodes is detected and stored in the capacitor, by writing a signal voltage closer to a potential which causes the driver element to turn off than the potential supplied to the gate electrode of the driver element when detecting a threshold value, the signal voltage being superimposed on the threshold voltage without losing the threshold voltage of the driver element.

3 Claims, 13 Drawing Sheets

DISPLAY APPARATUS

FIELD OF THE INVENTION

The present invention relates to an active matrix display apparatus in which a driver element is provided in each pixel for driving a light emitting element.

BACKGROUND OF THE INVENTION

Electroluminescence (EL) elements, unlike liquid crystal display apparatuses, require no backlight, allowing them to be suitable for thinner displays, and their viewing angle is not limited, there has been a growing demand for practical organic EL display apparatuses employing self-emissive organic electroluminescence (EL) element. Organic EL display apparatuses differ from liquid crystal display apparatuses employing liquid crystal cells in which display is controlled by a voltage, in that brightness of light emitted by the organic EL element used therein is controlled by the value of electric current flowing through the EL element.

FIG. 7 shows a pixel circuit in a known conventional active matrix type organic EL display apparatus. The pixel circuit includes an organic EL element 104 which is connected to a negative power source line 108 on the side of a cathode, a driver element 102 having a source electrode connected to the anode side of the organic EL element 104 and a drain electrode connected to a positive power source line 107, a capacitor 103 connected between a gate electrode and the source electrode of the driver element 102, and a switching element 101 having source and drain electrodes each connected to the gate electrode of the driver element 102 or to a signal line 105, and a gate electrode connected to a scanning line 106. Here, the switching element 101 and the drive element 102 are thin film transistors (TFTs).

The operation of the above-described pixel circuit will be described. It is first assumed that a voltage which is higher than the threshold voltage of the driver element 102 is stably stored by the capacitor 103 between the gate and source electrodes of the driver element 102. Accordingly, the driver element 102 is turned on.

In this state, the negative power source line 108 is set to a higher level than a voltage ground (GND) of the positive power source line 107. While the driver element 102 retains the on state, the potential of the anode electrode of the organic EL element 104 is made equal to the potential GND of the positive power source line 107 and a reverse bias voltage is applied to the organic EL element 104.

Then, after the potential of the scanning line 106 is set to a high level to turn the switching element 101 on, the potential of the signal line 105 is applied to the gate electrode of the driver element 102. Here, the potential of the signal line 105 corresponds to the potential GND of the positive power source line 107. This makes the potential of the anode electrode of the organic EL element 104 lower than the gate potential GND of the driver element 102 in accordance with the capacitance ratio between a capacitor component of the organic EL element 104 and the capacitor 103, causing the driver element 102 to be turned off.

Subsequently, when the potential of the negative power source line 108 is decreased to the level GND of the positive power source line 107, the potential of the source of the driver element 102 lowers in accordance with the voltage drop of the negative power source line 108, whereas the gate potential of the driver element 102 remains GND, which turns the driver element 102 on. Consequently, electric current is supplied from the positive power source line 107 through the driver element 102 to the anode electrode of the organic EL element 104, so that the potential of the anode electrode of the organic EL element 104 is gradually increased until the potential difference between the gate electrode of the driver element 102 and the anode electrode of the organic EL element 104 becomes equal to the threshold voltage of the driver element 102.

Then, the potential of the scanning line 106 is set to a low level, and the threshold voltage of the driver element 102 can be stored on the source electrode of the driver element 102 by the capacitor 103 and a capacitor component of the organic EL element 104.

Hereinafter, the process of storing the threshold voltage $V_t$ of the driver element 102 on the capacitor 103 as described above, will be referred to as "detection of a threshold voltage".

Then, a data voltage $V_{data}$ is supplied to the signal line 105. When the potential of the scanning line 106 is set to a high level and the data voltage $V_{data}$ is supplied to the gate electrode of the driver element 102, the potential of the source electrode of the driver element 102 changes due to a capacitance ratio between the capacitance value $C_s$ of the capacitor 103 and the capacitance value $C_{oled}$ of the organic EL element 104, whereby the potential between the gate and source electrodes of the driver element 102 becomes as follows:

$$Vgs=\{C_s/(C_s+C_{oled})\}\cdot V_{data}+V_t \quad \text{(equation 1)}$$

The above potential difference Vgs is stably stored by the capacitor 103. Hereinafter, the process of adding the data voltage will be referred to as "writing".

When the potential of the negative power source line 108 is decreased such that the potential difference between the positive power source line 107 and the negative power source line 108 is sufficiently greater than the threshold voltage of the organic EL element 104, the driver element 102 controls the electric current flowing through the organic EL element 104 in accordance with the voltage stored in the capacitor 103 by the above-described process, so that the organic EL element 104 continuously emits light with the brightness corresponding to the level of the electric current.

As described above, with the pixel circuit shown in FIG. 7, once the brightness information is written, the organic EL element 104 continuously emits light of a fixed brightness until the current writing state is cancelled (see page 2 and FIG. 1 of U.S. Published Patent Application No. 2004/0174349.)

In the pixel circuit of FIG. 7, however, at the moment in the above-described writing process when the data voltage is applied through the switching element 101, the driver element 102 turns on, as described above. Consequently, it is likely that the threshold voltage of the driver element 102 which is stored by the node between the capacitor 103 and the organic EL element 104 is lost, making it difficult to accurately superpose the information of the threshold voltage as represented by the above equation 1. In particular, as the data voltage $V_{data}$ increases and the writing time increases, the degree of threshold voltage which is lost also increases.

SUMMARY OF THE INVENTION

In accordance with one aspect of the present invention, there is provided an active matrix display apparatus comprising a light emitting element for emitting light in accordance with a level of an electric current supplied thereto; data writing means for writing a signal voltage corresponding to brightness of light to be emitted by the light emitting element; electric current level controlling means for controlling the level of electric current to be supplied to the light emitting element in accordance with the signal voltage written by the data writing means; and power source line controlling means for controlling a voltage at a power source line which supplies an electric current to the light emitting element so as to switch conduction and non-conduction of the light emitting element, wherein the data writing means includes a signal line for supplying a potential corresponding to the brightness of the emitted light; a signal line driving circuit for supplying a signal voltage corresponding to the brightness of the emitted light to the signal line; a switching element for controlling writing of the signal voltage supplied via the signal line; a scanning line for controlling the switching element; and a scanning line driving circuit for controlling the scanning line, the electric current level controlling means includes a driver element including a drain electrode connected to the light emitting element, for controlling the level of electric current flowing in the light emitting element in accordance with the signal voltage written by the data writing means; and a capacitor which is disposed between a gate electrode and the drain electrode of the driver element and stores the signal voltage which is written, and the power source line controlling means includes a power source supplying circuit for switching a voltage at the power source line.

In accordance with another aspect of the present invention, there is provided a display apparatus including pixel circuits disposed in a matrix, each pixel comprising a light emitting element for emitting light by means of an electric current supplied from a power source line; a driver element for controlling an electric current flowing in the light emitting element; a capacitor connected between a gate and a drain of the driver element; and a switching element which is turned on or off by a scanning line, for controlling supply of a signal voltage from a signal line to the gate of the driver element, wherein a voltage of the power source line is set to a voltage which turns the light emitting element off, and, while the light emitting element is in an off state, a fixed power source voltage is applied to each of a source and the gate of the driver element and a voltage in accordance with a threshold voltage of the driver element is set to the drain of the driver element, and then, while the driver element remains off, the switching element is turned on to supply a signal voltage from the signal line to the gate of the driver element, thereby charging the capacitor with the signal voltage and a voltage in accordance with the threshold voltage of the driver element, and subsequently, the switching element is turned off and the voltage of the power source line is set to a voltage which turns the light emitting element on, whereby a voltage in accordance with the signal voltage which compensates for the threshold voltage of the driver element is set to the gate of the driver element, and an electric current is then supplied from the driver element to the light emitting element to thereby cause the light emitting element to emit light.

According to the present invention, a capacitor is provided between a gate electrode and a drain electrode of a driver element, and a threshold voltage at the gate-drain electrodes of the driver element when a light emitting element emits light is detected and stored in the capacitor. Then, when writing a signal voltage, by writing a pixel data signal having a potential closer to the potential which causes the driver element to turn off than the potential supplied to the gate electrode of the driver element at the time of detecting the threshold voltage, the pixel data signal can be reliably superimposed on the threshold voltage without losing the threshold voltage of the driver element which is stored in the capacitor at the time of signal voltage writing.

BRIEF DESCRIPTION OF THE DRAWINGS

Preferred embodiments of the present invention will be described in detail based on the following drawings, wherein.

DETAILED DESCRIPTION OF PREFERRED EMBODIMENTS

Preferred embodiments of the present invention will be described in further detail with reference to the drawings. It should be noted that the following embodiments are illustrative and do not limit the present invention.

Embodiment 1

Figure 1:
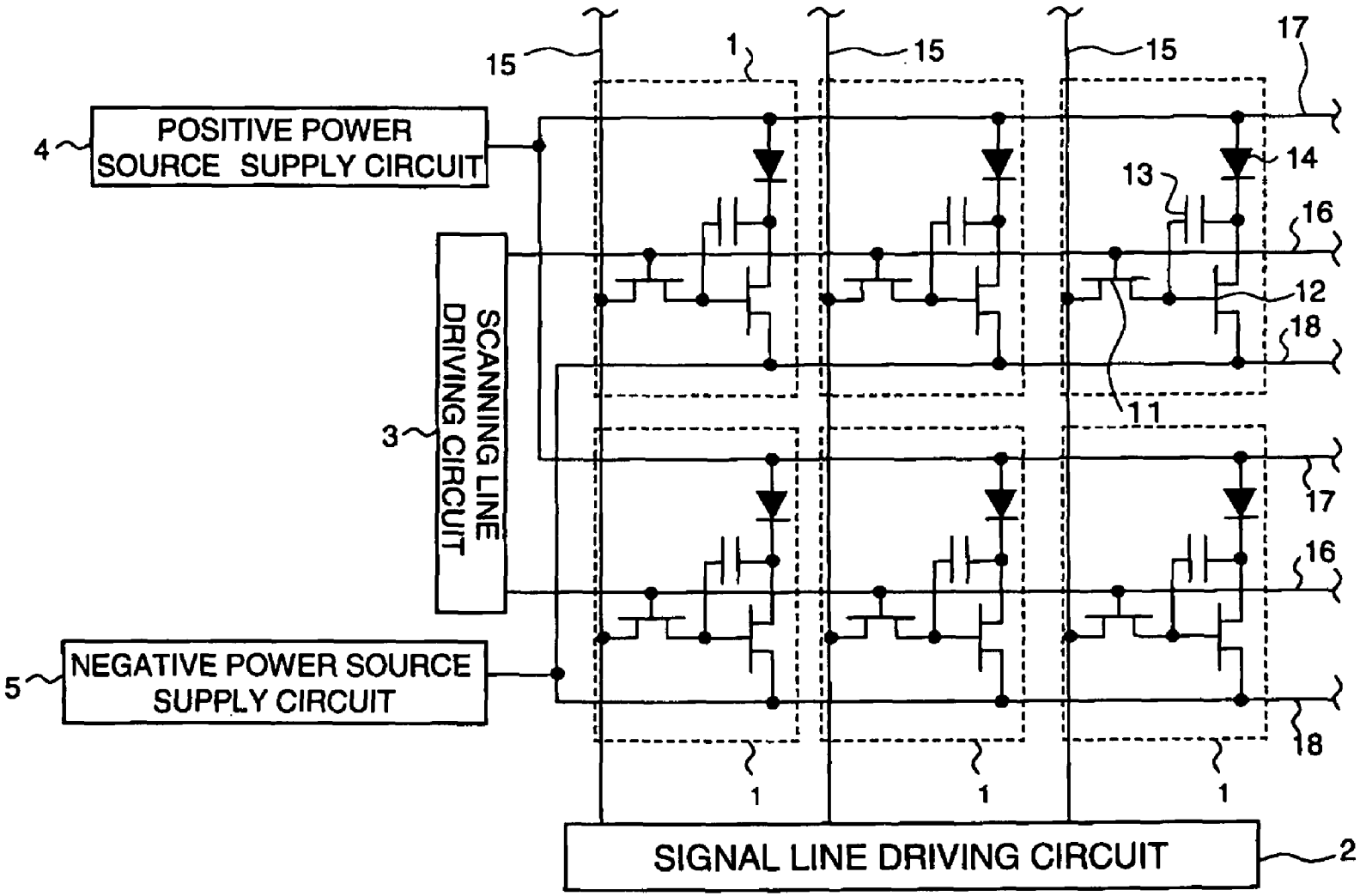
FIG. 1 is a diagram showing a structure of a display apparatus according to one embodiment of the present invention.
Figure 2:
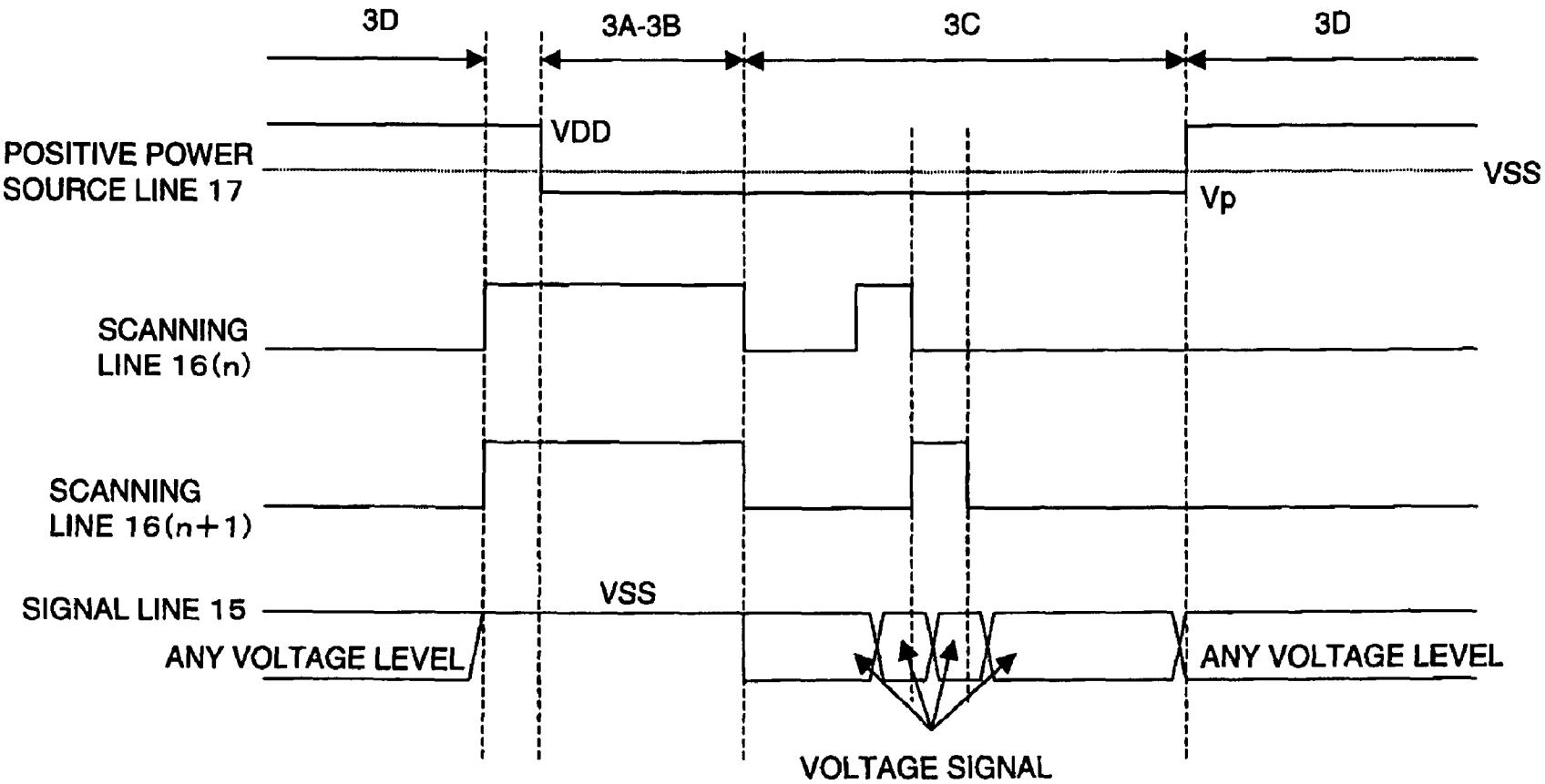
FIG. 2 is a timing chart of the display apparatus according to the embodiment shown in FIG. 1.

FIG. 1 shows a circuit structure of a display apparatus to which the present invention is applied, and FIG. 2 shows a timing chart of the apparatus shown in FIG. 1.

The display apparatus includes a great number of pixels which are arranged in a matrix. Each pixel includes an organic EL light emitting element (OLED) which is a light emitting element, and a circuit for controlling the light emission of the light emitting element.

A positive power source supply circuit 4, which outputs a positive power source voltage $V_{DD}$, switches its output to a voltage Vp which is lower than a negative power source voltage $V_{SS}$ at predetermined timing and supplies this voltage Vp to each pixel. A signal line driving circuit 2 supplies a signal voltage $V_{data}$ to be displayed in each pixel to each signal line 15 provided for each vertical line. A scanning line driving circuit 3 supplies a drive signal for a scanning line 16 provided for each horizontal line. A negative power source supply circuit 5 supplies a negative power source voltage $V_{SS}$ which causes an electric current to flow in the light emitting element to each pixel. A drive circuit includes the signal line driving circuit 2 and the scanning line driving circuit 3.

In each pixel circuit, the positive power source line 17 is connected to the positive power source supply circuit 4, and the positive power source line 17 is also connected to an anode electrode of a light emitting element 14. A drain electrode of the n-type driver element 12 is connected to a cathode electrode of the light emitting element 14, and a source electrode of a driver element 12 is connected to a negative power source line 18. A capacitor 13 is connected between the gate electrode and the drain electrode of the driver element 12. The light emitting element 14 has a capacity component 14*a* whose capacity is $C_{oled}$.

The gate electrode of the driver element 12 is connected to a source of a switching element 11. A drain and a gate of the switching element 11 are connected to a signal line 15 and a scanning line 16, respectively.

Here, while an n-type TFT is adopted for the switching element 11, a p-type TFT may also be adopted. If the type of the TFT is changed, the polarity of a signal to be supplied to the scanning line must also be reversed. The driver element 12 is an n-type TFT. In addition, numeral 1 in FIG. 1 denotes a pixel.

The operation of the above-described pixel circuit will be described using the timing chart of FIG. 2 and FIGS. 3A-3D.

It is first assumed that the capacitor 13 has stored voltage ($V_{data}$+Vt) in the previous frame. Here, $V_{data}$ represents brightness data concerning an amount of light emitted by the light emitting element of the target pixel, and $V_t$ represents a threshold voltage of the driver element 12 of the target pixel.

In this state, when the writing timing for the target pixel (the target horizontal line) is reached, the potential of the scanning line 16 is set to a level (an H level in this example) which places the switching element 11 in a conducting state. Further, the potential of the signal line 15 is made equal to the potential $V_{SS}$ of the negative power source line 18, to turn the driver element 12 off.

Figure 3A:
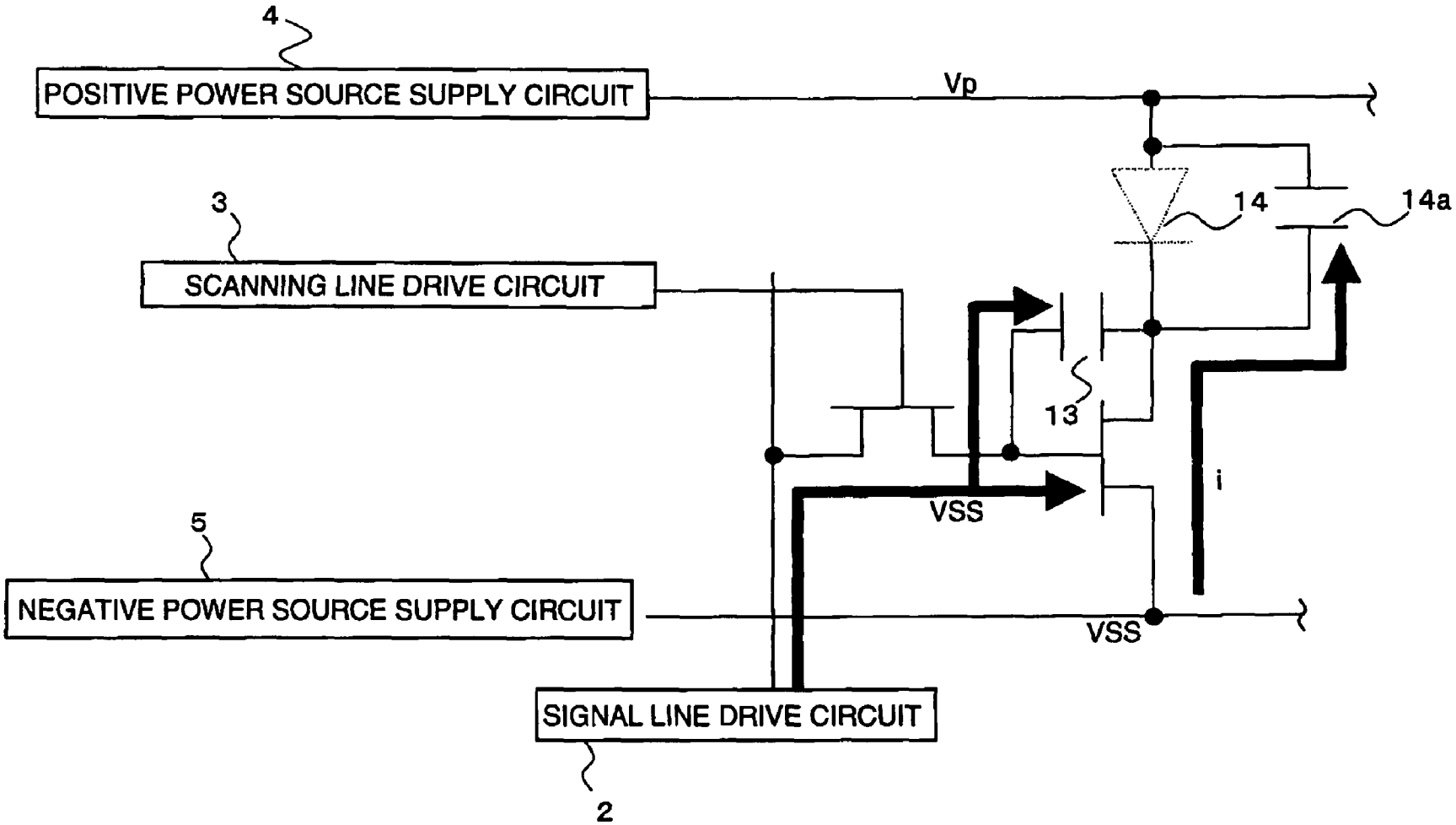
FIG. 3A is a diagram showing the initial state of the threshold voltage detection process 3A-3B of FIG. 2.
Figure 3B:
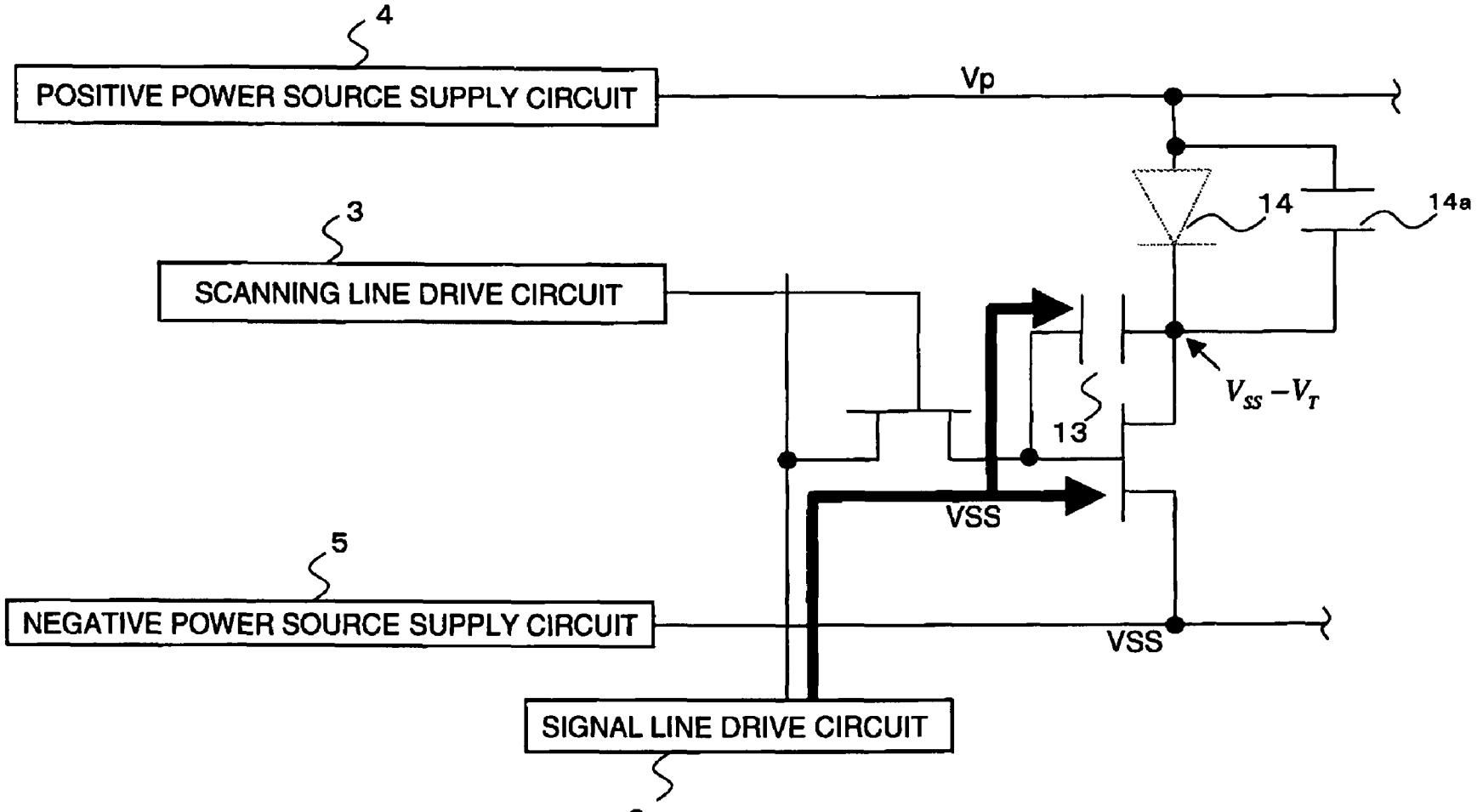
FIG. 3B is a diagram showing the late state of the threshold voltage detection process 3A-3B of FIG. 2.
Figure 3C:
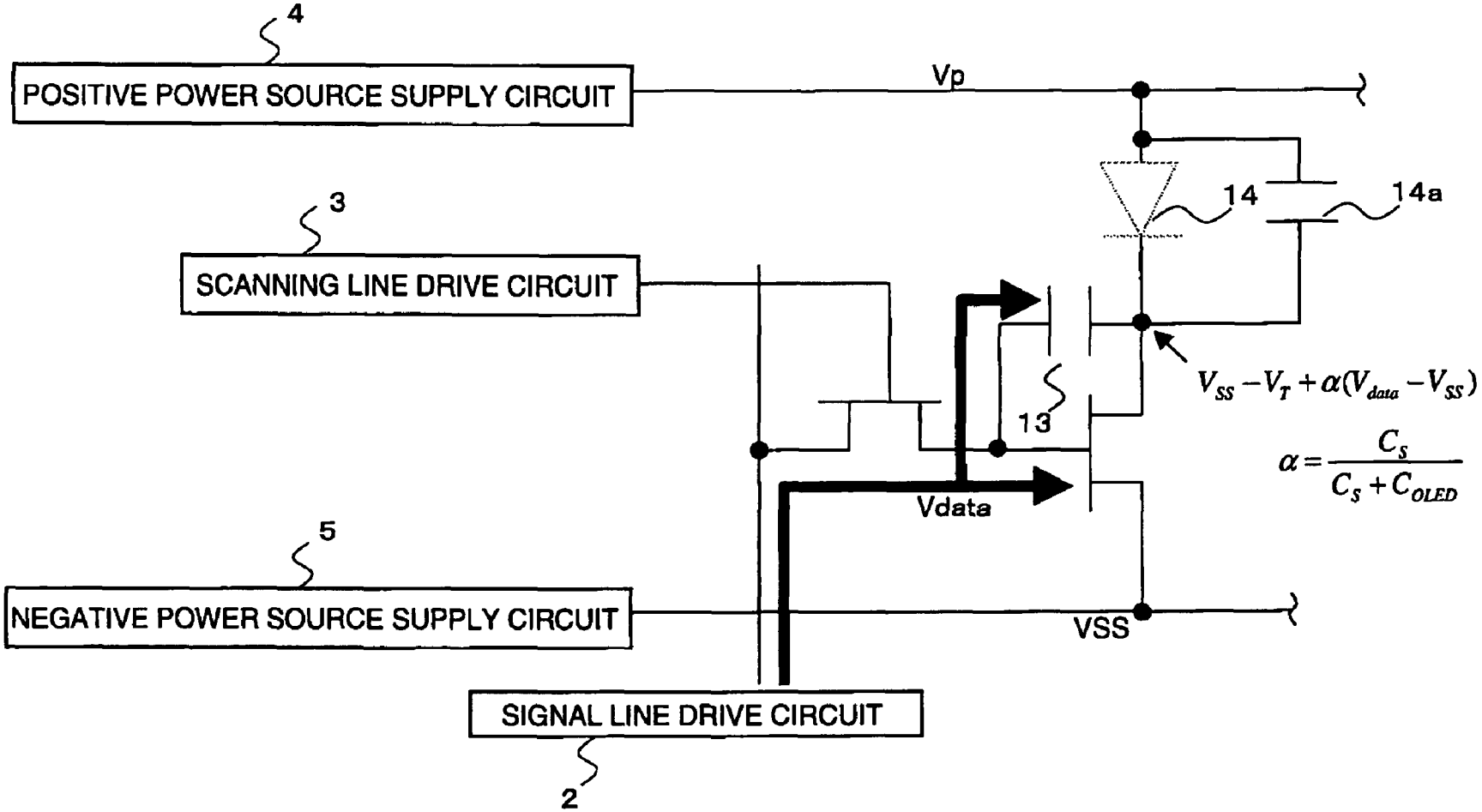
FIG. 3C is a diagram showing the state of the writing process 3C of FIG. 2.
Figure 3D:
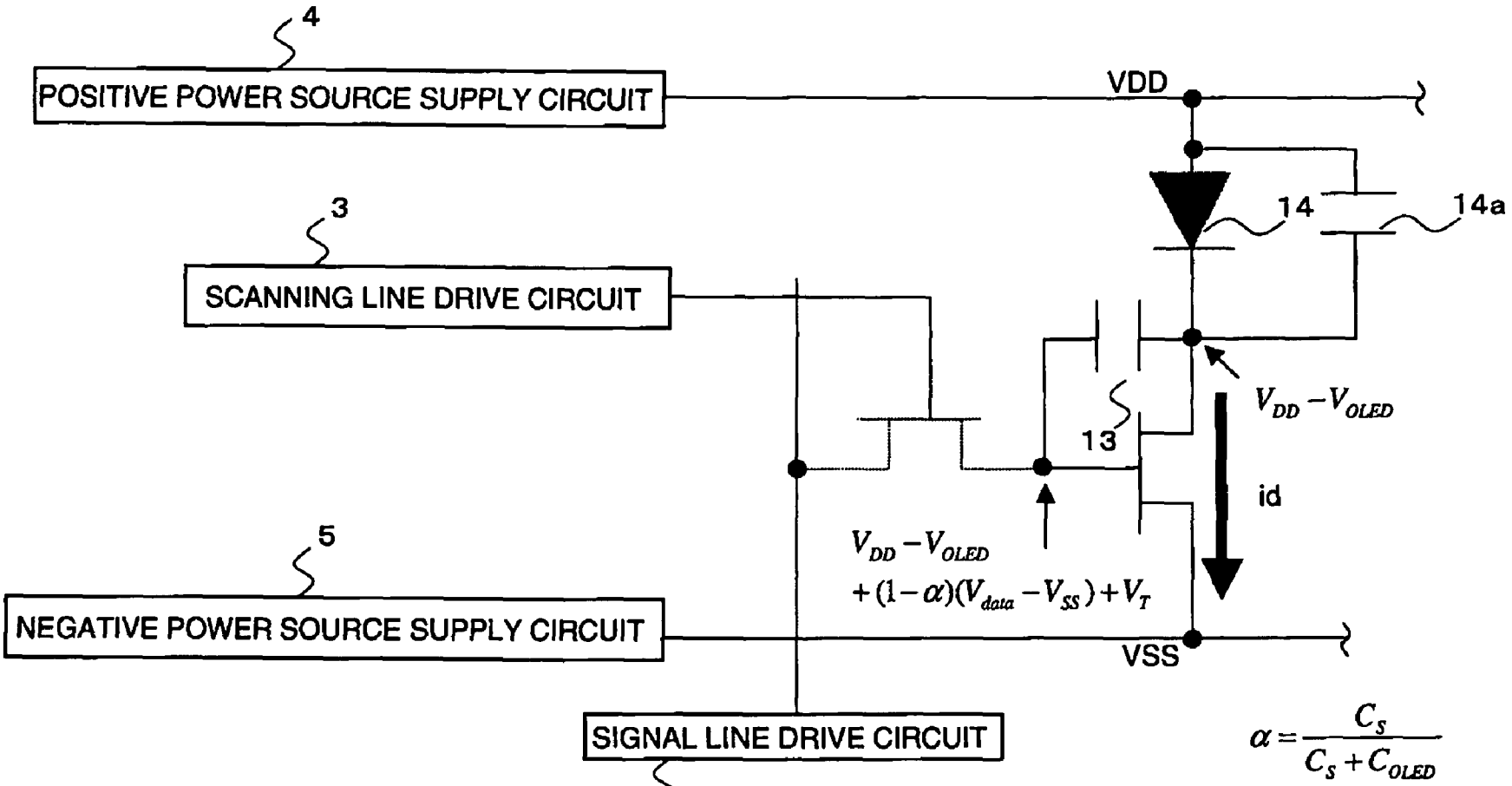
FIG. 3D is a diagram showing the state of the light emitting process 3D of FIG. 2.

Then, as shown in FIG. 3A, the potential of the positive power source line 17 is set to Vp which is lower than $V_{SS}$. Assuming that the voltage drop of the light emitting element 14 corresponds to $V_{oled}$, the potential of the drain electrode of the drive element 12 must have been $V_{DD}$-$V_{oled}$ when the potential of the positive power source line 17 was $V_{DD}$. Then, when the potential of the positive power source 17 changes from $V_{DD}$ to Vp, the difference is distributed between the capacitor component 14*a* ($C_{oled}$) of the light emitting element 14 and the capacitor component $C_s$ of the capacitor 13. Accordingly, the potential of the drain electrode of the driver element 12 at the moment the potential of the positive power source line 17 becomes Vp is represented as $V_{DD}-V_{oled}+\{C_{oled}/(Cs+C_{oled})\}(Vp-V_{DD})$. Here, assuming that the maximum value in the range of the threshold voltage of the driver element 12 which needs to be compensated is Vt(TFT) (>0), Vp is set such that the following equation can be satisfied:

$$V_{SS}-V_t(TFT) \geqq V_{DD}-V_{oled}+\{C_{oled}/(Cs+C_{oled})\}(Vp-V_{DD}) \quad \text{(equation 2)}$$

Specifically, Vp is set such that the drain voltage of the driver element 12 is below the value obtained by subtracting $V_t$ (TFT) from the gate and source voltages $V_{SS}$ of the driver element 12.

Accordingly, from the moment the potential of the positive power source line 17 becomes Vp, the processes of detecting the threshold voltage of the driver element 12 is started. Then, as shown in FIG. 3A, an electric current flows from the source to the drain of the driver element 12, and the potential corresponding to $V_{SS}-V_t$ is generated at the drain electrode of the driver element 12 (see FIG. 3B). This process 3A-3B(1) of detecting the threshold voltage is performed for all the pixels simultaneously.

Subsequently, the potential of the scanning line 16 is changed to a level (an L level in this example) which places the switching element 11 in a non-conducting state, and then the process 3C of writing of a pixel signal to each pixel is started. More specifically, after setting the potential of the signal line 15 to $V_{data}$, the potential of the scanning line 16 is changed, once again, to a level which places the switching element 11 in a conducting state, and the gate potential of the driver element 12 is set to $V_{data}$ ($<V_{SS}$). This changes the gate voltage of the driver element 12 from $V_{SS}$ to $V_{data}$, and the changing amount is distributed between the capacitor component $C_s$ of the capacitor 13 and the capacitor component $C_{oled}$ of the light emitting element 14, so that the potential of the drain electrode of the driver element 12 changes from $V_{SS}$-$V_t$ to $V_{SS}-Vt+\{C_s/(C_s+C_{oled})\}(V_{data}-V_{SS})$ (see FIG. 3B).

Accordingly, at this time, the capacitor 13 is charged with a voltage corresponding to $V_{data}-(V_{SS}-V_t+\{C_s/(C_s+C_{oled})\}(V_{data}-V_{SS}))$.

This writing process 3C is performed in a line sequential manner as shown in FIG. 2. However, with regard to one horizontal line, data writing may be performed simultaneously or in a dot sequential manner.

Then, the potential of the positive power source line 17 is changed to $V_{DD}$ such that the voltage applied to the light emitting element 14 becomes sufficiently greater than the threshold voltage of the light emitting element 14. This changes the drain voltage of the driver element 12 to $V_{DD}$-$V_{oled}$. Accordingly, the gate voltage of the driver element 12 has a value obtained by adding to $V_{DD}$-$V_{oled}$ the charged voltage of the capacitor 13, $V_{data}-(V_{SS}-V_t+\{C_s/(C_s+C_{oled})\}(V_{data}-V_{SS}))=(1-\{C_s/(C_s+C_{oled})\}(V_{data}-V_{SS}))+V_{SS}$.

Thus, the potential difference between the gate and source electrodes of the driver element 12 at that time becomes as follows (see FIG. 3D):

$$Vgs=V_{DD}-V_{oled}-V_{SS}+(V_{data}-V_{SS})\{C_{oled}/(Cs+C_{oled})\}+Vt \quad \text{(equation 3)}$$

Therefore, the electric current id which flows in the driver element 12 is represented as follows:

$$\begin{aligned} id &= (\beta/2)(Vgs-V_t)^2 \quad \text{(equation 4)} \\ &= (\beta/2)(V_{DD}-V_{oled}-V_{SS}+(V_{data}-V_{SS})\{C_{oled}/(Cs+C_{oled})\})^2 \end{aligned}$$

The electric current id described above is supplied to the light emitting element 14. The id is irrespective of $V_t$, whereby the threshold voltage of the driver element 12 for the light emitting element 14 is compensated.

According to the present embodiment, a capacitor is disposed between the gate electrode and the drain electrode of the driver element 12, and a threshold voltage between the gate and drain electrodes of the driver element 12 when the light emitting element 14 emits light is detected. Then, at the time of signal writing, by supplying, as a pixel signal, a voltage which is lower than the potential supplied to the gate electrode of the driver element 12 when detecting the threshold voltage, the brightness data $V_{data}$ can be reliably superimposed on the gate of the driver element 12 without losing the threshold voltage $V_t$ of the driver element 12 which is stored in the capacitor 13.

Embodiment 2

Figure 4:
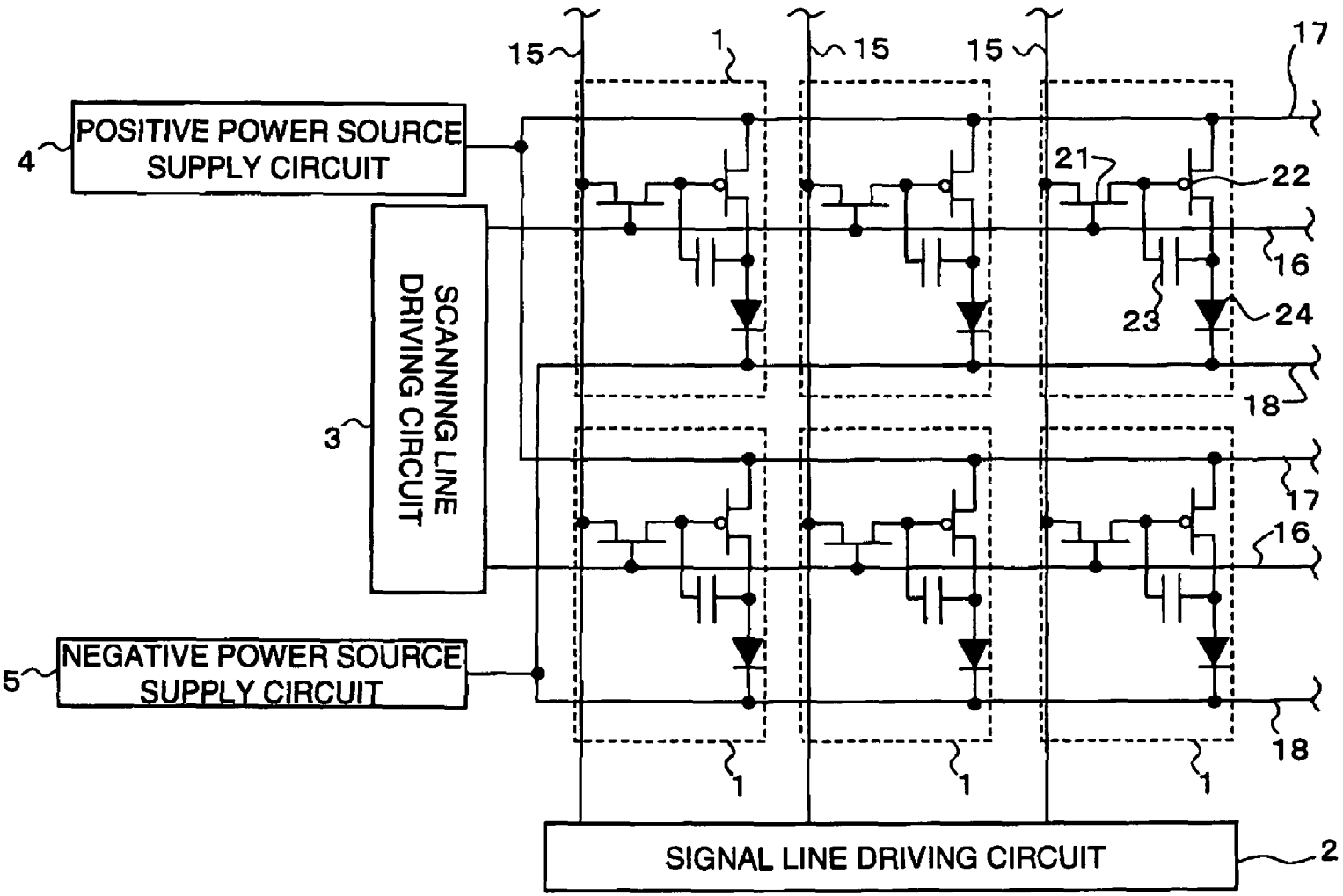
FIG. 4 is a diagram showing a structure of a display apparatus according to another embodiment of the present invention.
Figure 5:
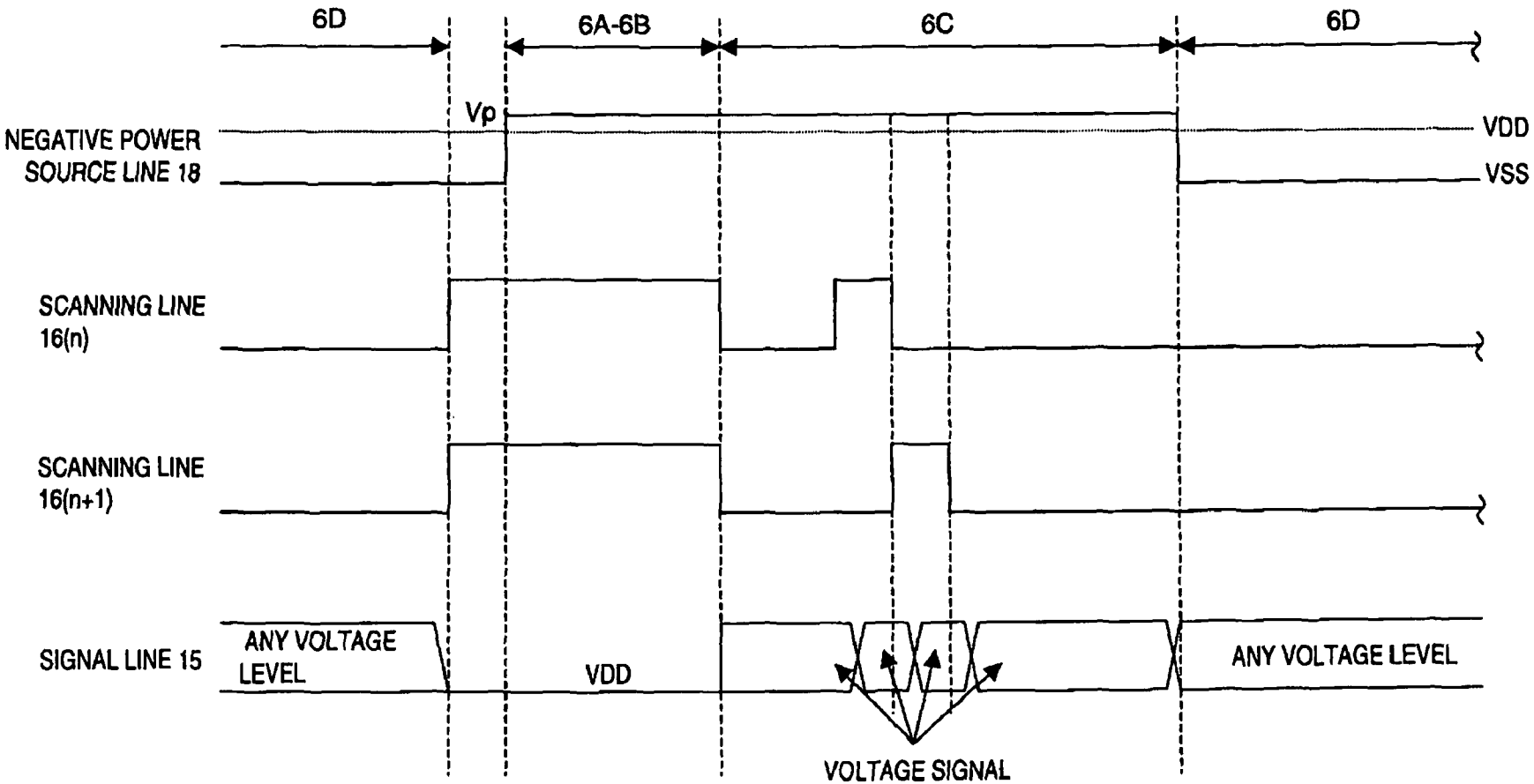
FIG. 5 is a timing chart of the display apparatus according to the embodiment shown in FIG. 4.

FIG. 4 shows a circuit structure of another display apparatus to which the present invention is applied and FIG. 5 is a timing chart of the display apparatus shown in FIG. 4.

This apparatus includes a light emitting element 24 having a cathode electrode connected to the negative power source line 18, a driver element 22 having a drain electrode connected to an anode electrode of the light emitting element 24 and a source electrode connected to a positive power source line 17, a capacitor 23 connected between a gate electrode and the drain electrode of the driver element 22, and a switching element 21 having a source electrode and a drain electrode each connected to the gate electrode of the driver element 22 or the signal line 15 and a gate electrode connected to the scanning line 16. The switching element 21 is either n-type or p-type TFT and the driver element 22 is a p-type TFT. The light emitting element 24 has a capacity component 24*a* whose capacitance is $C_{oled}$. In addition, numeral 1 in FIG. 4 denotes a pixel.

The operation of the above-described pixel circuit will be described using the timing chart of FIG. 5 and FIG. 6. In the illustrated example, the capacitor 23 has stored voltage ($V_{data}-V_t$) in the previous frame.

Figure 6A:
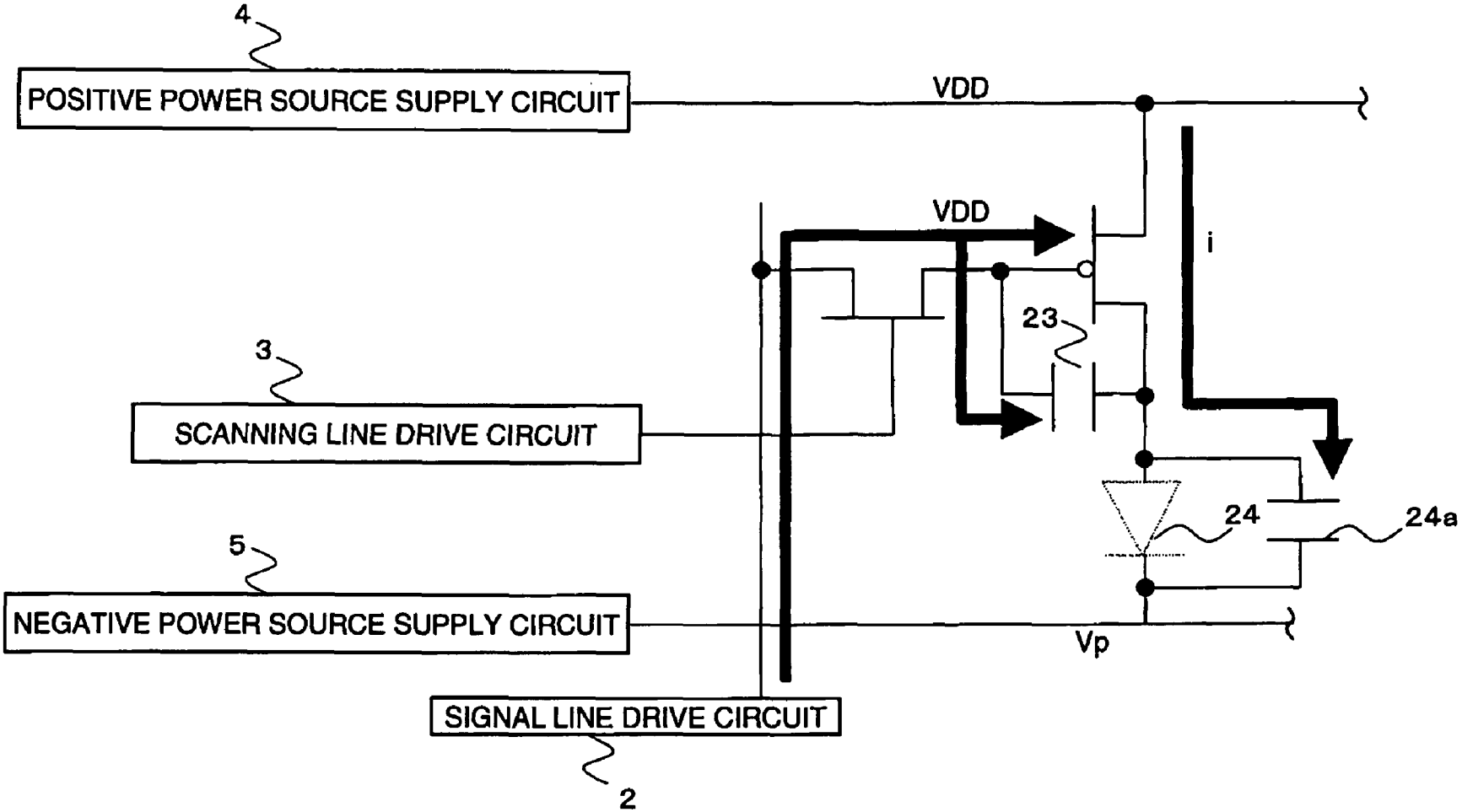
FIG. 6A is a diagram showing the initial state of the threshold voltage detection process 6A-6B of FIG. 5.
Figure 6B:
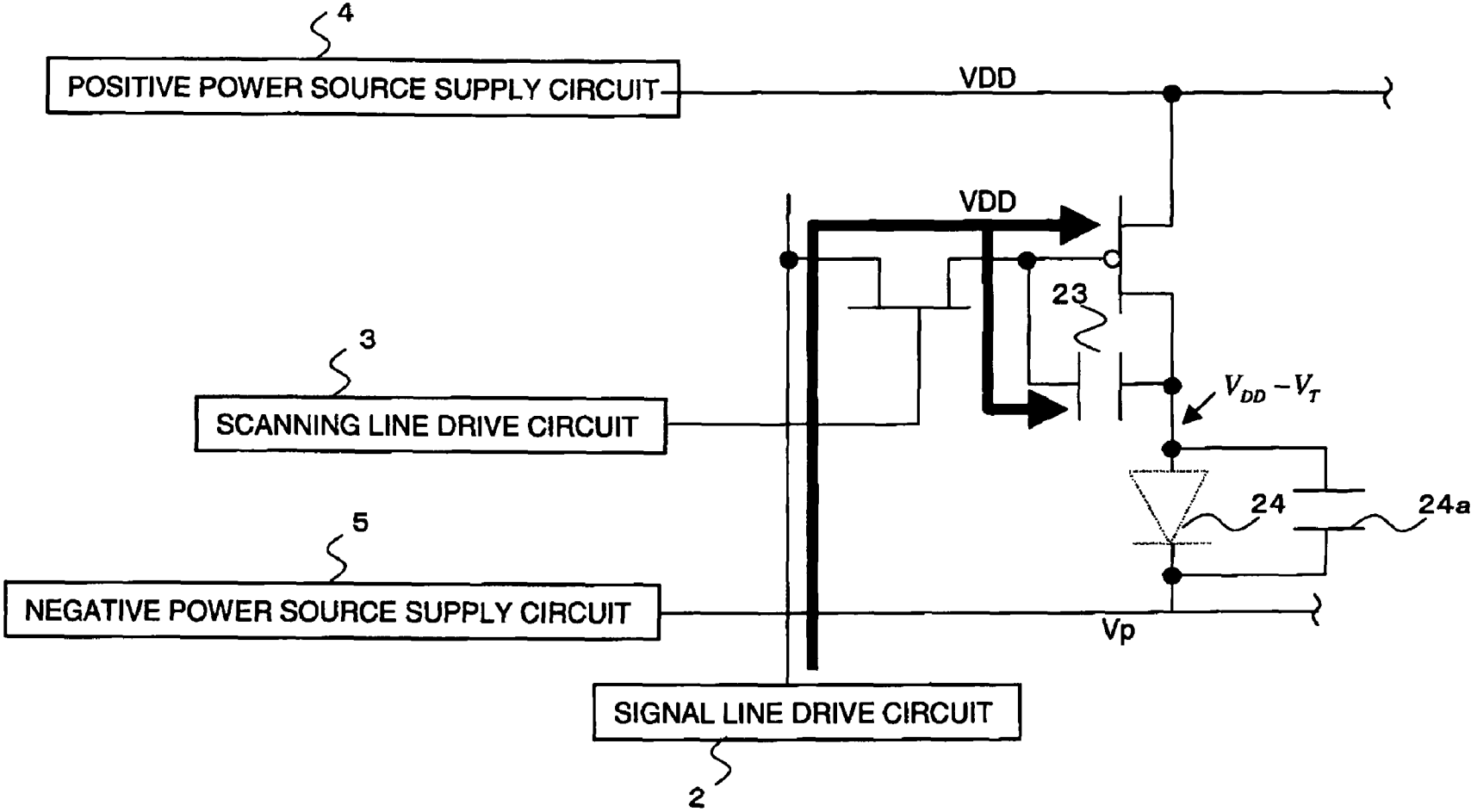
FIG. 6B is a diagram showing the late state of the threshold voltage detection process 6A-6B of FIG. 5.
Figure 6C:
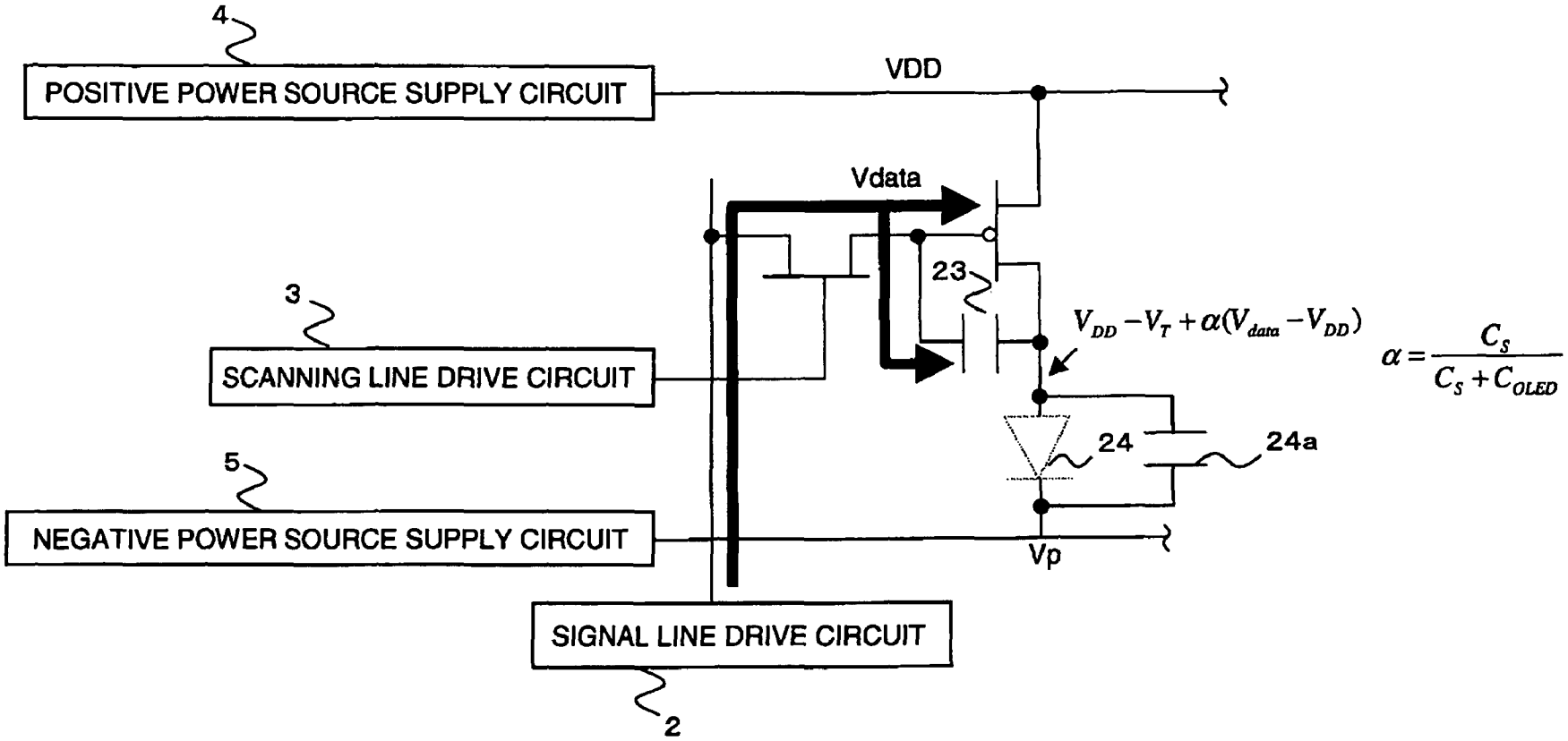
FIG. 6C is a diagram showing the state of the writing process 6C of FIG. 5.
Figure 6D:
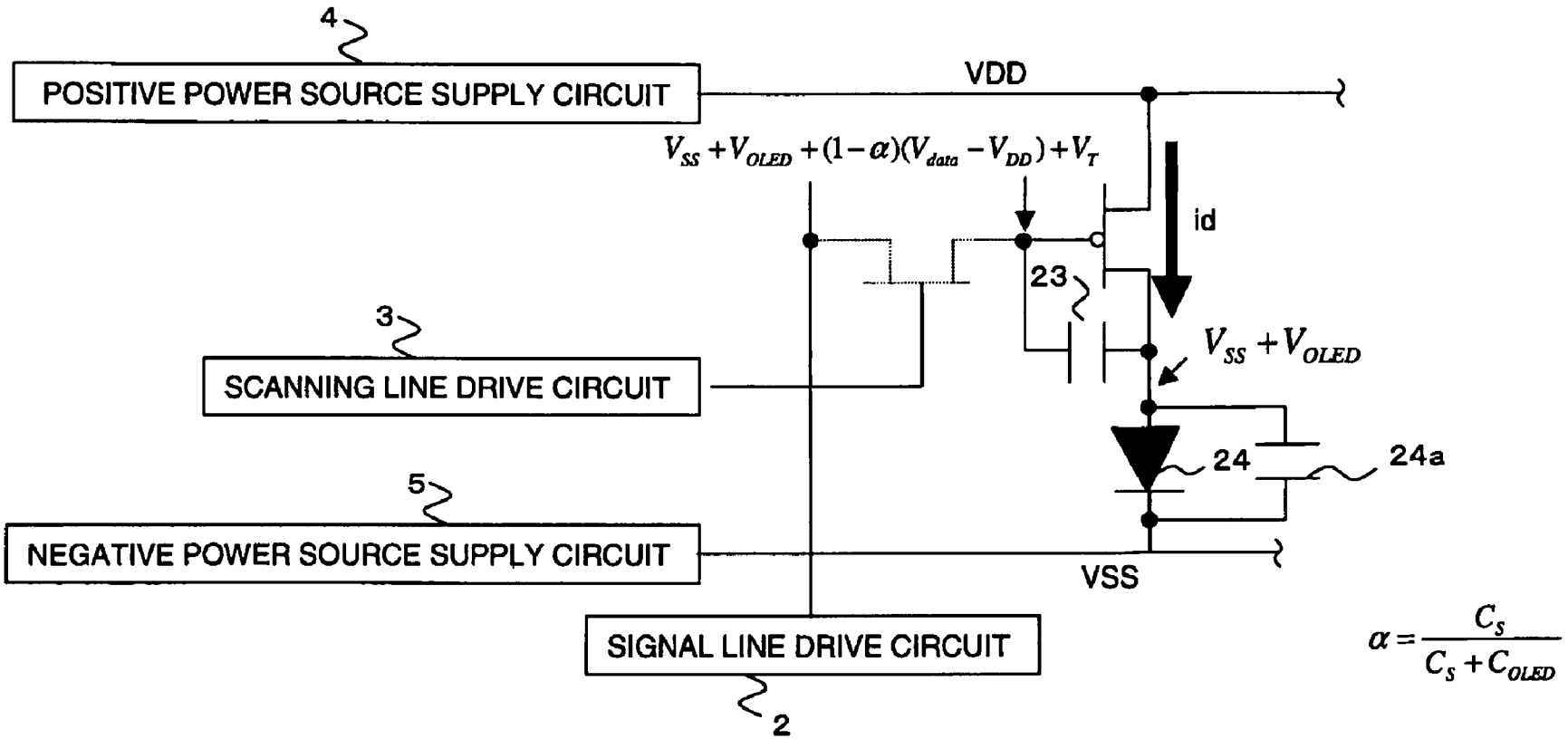
FIG. 6D is a diagram showing the state of the light emitting process 6D of FIG. 5.
Figure 7:
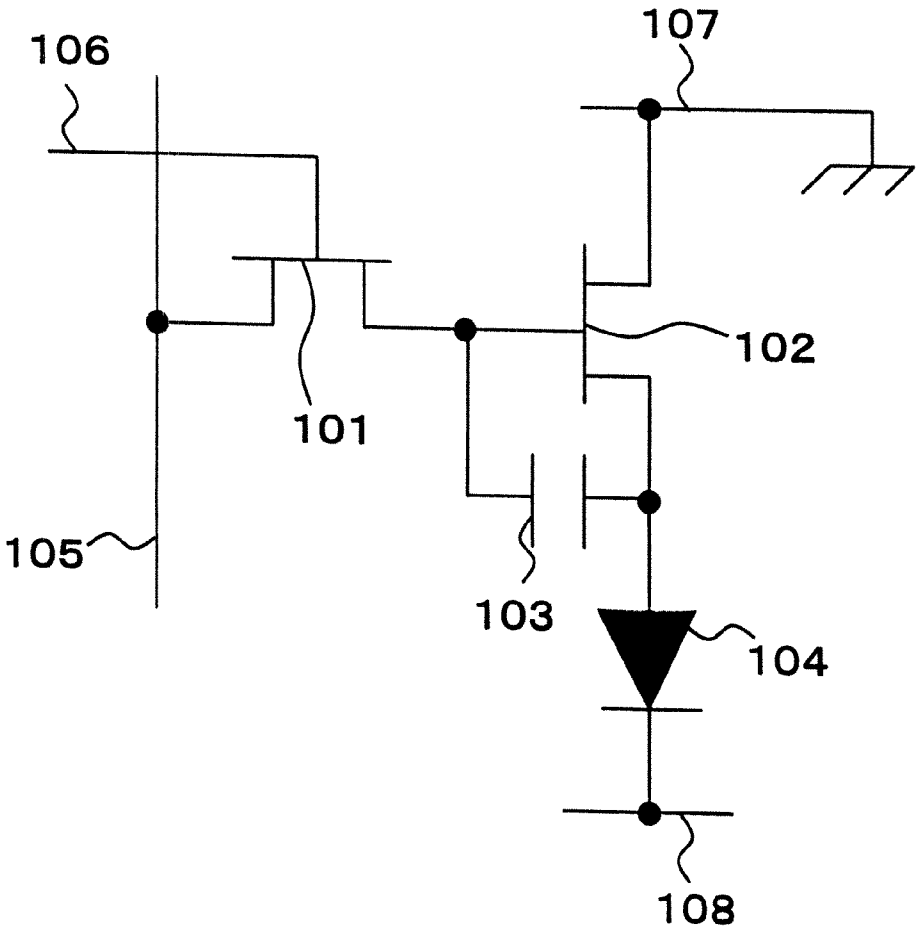
Fig. 7 RELATED ART
FIG. 7 is a diagram showing a structure of a conventional prior art pixel circuit.

First, the potential of the scanning line 16 is set to a level (an H level in this example) which places the switching element 21 in a conducting state. Further, the potential of the signal line 15 is made equal to the potential $V_{DD}$ of the positive power source line 17, to cause the driver element 22 to turn off. Then, as shown in FIG. 6A, the potential of the negative power source line 18 is set to Vp which is higher than $V_{DD}$. The potential of the drain electrode of the driver element 22 at the moment the potential of the negative power source line becomes Vp is represented as $V_{oled}+\{C_{oled}/(C_s+C_{oled})\}(Vp-V_{SS})$. Here, assuming that the maximum value in the range of the threshold voltage of the driver element 22 which needs to be compensated is $V_t$(TFT) (<0), Vp is set such that the following equation can be satisfied:

$$V_{DD}-V_t(TFT)\leqq V_{oled}+\{C_{oled}/(C_s+C_{oled})\}(Vp-V_{DD}) \quad \text{(equation 5)}$$

From the moment the potential of the negative power source line 18 becomes Vp, the processes 6A-6B of detecting the threshold voltage of the driver element 22 is started. Then, the potential corresponding to $V_{DD}$-$V_t$ is generated at the drain electrode of the driver element 22 (see FIG. 6B).

Then, the potential of the scanning line 16 is changed to a level (an L level in this example) which places the switching element 21 in a non-conducting state, and then the process 6C of writing of a pixel signal to each pixel is started. More specifically, after setting the potential of the signal line 15 to $V_{data}$, the potential of the scanning line 16 is switched once again to the level (the H level in this example) which places the switching element 21 in a conducting state and the gate potential of the driver element 22 is set to $V_{data}$ (>$V_{DD}$). Consequently, the potential of the drain electrode of the driver element 22 changes to $V_{DD}+\{C_s/(C_s+C_{oled})\}(V_{data}-V_{DD})-V_t$ (see FIG. 6C).

Then, the potential of the negative power source line 18 is set to $V_{SS}$ such that the voltage applied to the light emitting element 24 becomes sufficiently lower than the threshold voltage of the light emitting element 24 and also the switching element 21 is turned off by the scanning line 26. This makes the drain voltage of the driver element 22 $V_{SS}+V_{oled}$. Accordingly, the gate voltage of the driver element 22 has a value of $V_{SS}+V_{oled}+(1-\{C_s/(C_s+C_{oled})\}(V_{data}-V_{DD}))+V_t$.

Thus, the potential difference between the gate and source electrodes of the driver element 22 at that time becomes as follows (see FIG. 6D):

$$Vgs=V_{DD}-V_{oled}-V_{SS}+(V_{data}-V_{DD})\{C_{oled}/(C_s+C_{oled})\}-V_t \quad \text{(equation 6)}$$

Therefore, the electric current id flowing in the driver element 22 becomes as follows:

$$\begin{aligned} id &= (\beta/2)(Vgs+V_t)^2 \\ &= (\beta/2)(V_{DD}-V_{oled}-V_{SS}+ \\ &\quad (V_{data}-V_{DD})\{C_{oled}/(C_s+C_{oled})\})^2 \end{aligned}$$

Thus, the threshold voltage of the driver element 22 is compensated.

While the preferred embodiments of the present invention have been described using specific terms, such description is for illustrative purposes only, and it is to be understood that changes and variations may be made without departing from the spirit or scope of the appended claims.

PARTS LIST

1 pixel
2 signal line driving circuit
3 scanning line driving circuit
4 positive power source circuit
5 negative power source supply circuit
11 switching element
12 driver element
13 capacitor
14 light emitting element
14*a* component
15 signal line
16 scanning line
17 positive power source line
18 negative power source line
21 switching element
22 driver element
23 element
23 capacitor
24 light emitting element
24*a* component
101 switching element
102 driver element
103 capacitor
104 organic EL element
105 signal line
106 scanning line
107 positive power source line
108 negative power source

The invention claimed is:

1. Method for compensating for a threshold voltage of a driver element, comprising:

(a) providing a light emitting element having a first electrode, connected to a first power source line, and a second electrode wherein the light emitting element has a threshold voltage;

(b) providing the driver element having the threshold voltage, a gate electrode, a first electrode connected to the second electrode of the light emitting element, and a second electrode connected to a second power source line, so that the driver element controls current flowing in the light emitting element;

(c) providing a switching element having a gate electrode connected to a switching line, a first electrode connected to the gate electrode of the driver element, and a second electrode connected to a signal line;

(d) providing a capacitor disposed between the gate and first electrodes of the driver element; and (e) performing the following steps in order:

(i) setting the potential of the scanning line to a first level to turn the switching element on and applying a selected first voltage to the signal line and to the second power source line, wherein the selected first voltage is applied to the gate and second electrodes of the driver element;

(ii) applying a selected second voltage to the first power source line such that the potential difference across the light emitting element is less than the threshold voltage of the light emitting element, wherein the light emitting element is turned off, a first electric current flows through the driver element in a first direction, and the threshold voltage of the driver element is stored in the capacitor;

(iii) applying a selected data voltage to the signal line, wherein the selected data voltage is applied to the gate electrode of the driver element and setting the potential of the scanning line to a second level to turn the switching element off; and (iv) applying a selected third voltage to the first power source line such that the potential difference across the light emitting element is greater than the threshold voltage of the light emitting element, wherein a second electric current flows through the driver element in a second direction and is thereby supplied to the light emitting element to cause it to emit light; wherein the second electric current is irrespective of the threshold voltage of the driver element, and therefore compensation is made for the threshold voltage of the driver element.

2. The method of claim 1, wherein the driver element is an n-type TFT, the first electrode of the driver element is a drain electrode, the second electrode of the driver element is a source electrode, the first electrode of the light emitting element is an anode, the second electrode of the light emitting element is a cathode, the first power source line is a positive power source line, the second power source line is a negative power source line, the selected data voltage is less than the selected first voltage, the selected second voltage is less than the selected first voltage, and the selected third voltage is greater than the selected second voltage.

3. The method of claim 1, wherein the driver element is an p-type TFT, the first electrode of the driver element is a drain electrode, the second electrode of the driver element is a source electrode, the first electrode of the light emitting element is a cathode, the second electrode of the light emitting element is an anode, the first power source line is a negative power source line, the second power source line is a positive power source line, the selected data voltage is greater than the selected first voltage, the selected second voltage is greater than the selected first voltage, and the selected third voltage is less than the selected second voltage.

* * * * *